United States Patent [19]

Annovi

[11] Patent Number: 4,798,933

[45] Date of Patent: Jan. 17, 1989

[54] SKI-BOOT HEATER

[75] Inventor: Giuseppe Annovi, Montebelluna, Italy

[73] Assignee: Dolomite S.p.A., Montebelluna, Italy

[21] Appl. No.: 68,087

[22] Filed: Jun. 30, 1987

[30] Foreign Application Priority Data

Jul. 3, 1986 [IT] Italy ..... 53595/86[U]

[51] Int. Cl.[4] ..... H05B 1/02

[52] U.S. Cl. ..... 219/211; 219/527; 36/2.6

[58] Field of Search ..... 219/211, 215, 527, 528, 219/529, 548, 549, 385; 36/2.6

[56] References Cited

U.S. PATENT DOCUMENTS

| | | | |
|---|---|---|---|
| 2,571,918 | 10/1951 | Meninger | 219/385 |
| 3,079,486 | 2/1963 | Winchell | 219/528 |
| 3,443,067 | 5/1969 | Morgan | 219/529 |
| 3,626,152 | 12/1971 | Governale | 219/385 |
| 3,663,796 | 5/1972 | Hines | 36/2.6 |
| 3,859,496 | 1/1975 | Giese | 219/527 |
| 4,087,675 | 5/1978 | Sansonetti | 219/527 |
| 4,273,989 | 6/1981 | Hinton | 219/527 |
| 4,279,255 | 7/1981 | Hoffman | 219/527 |
| 4,507,877 | 4/1985 | Vaccari | 219/211 |

*Primary Examiner*—E. A. Goldberg
*Assistant Examiner*—Teresa J. Walberg
*Attorney, Agent, or Firm*—Sughrue, Mion, Zinn, Macpeak & Seas

[57] ABSTRACT

A ski-boot heater has a heating resistor and a battery mounted in the boot and a socket is provided in the boot for connecting the resistor and the battery to an external voltage source. A control circuit enables the battery to be recharged with direct current when the socket is connected to an external AC or DC supply and when the battery is being recharged enables the resistor to be supplied with electrical power greater than that normally supplied to the resistor by the battery.

6 Claims, 3 Drawing Sheets

SKI-BOOT HEATER

SUMMARY OF THE INVENTION

The present invention relates to a ski-boot heater.

More particularly, the invention concerns a heater, comprising:

at least one heating resistor and at least one storage battery for mounting in a ski-boot, the storage battery being rechargeable through a socket mounted in the boot in a position accessible from the exterior, and circuit means for controlling the supply of current to the resistor, including a manually-operable switch for controlling the supply of current from the battery to the resistor.

The heater of the present invention is characterised in that the control circuit means include a control and recharging circuit for enabling the supply of current to the heating resistor even when the at least one storage battery is connected through the socket to an external electrical supply for recharging it.

According to a further characteristic, the control circuit means are arranged to enable the heating resistor to be supplied with greater power than that normally supplied to the resistor as a result of the operation of the switch, each time the at least one battery is being recharged.

By virtue of these characteristics, each time the battery or batteries are being suitably recharged before use of the ski-boot, the heater of the invention automatically preheats the ski-boot, removing any residual moisture.

BRIEF DESCRIPTION OF THE DRAWINGS

Further characteristics and advantages of the heater according to the invention will become apparent from the detailed description which follows with reference to the appended drawings, provided purely by way of non-limiting example, in which.

DESCRIPTION OF THE PREFERRED EMBODIMENT

Figure 1:
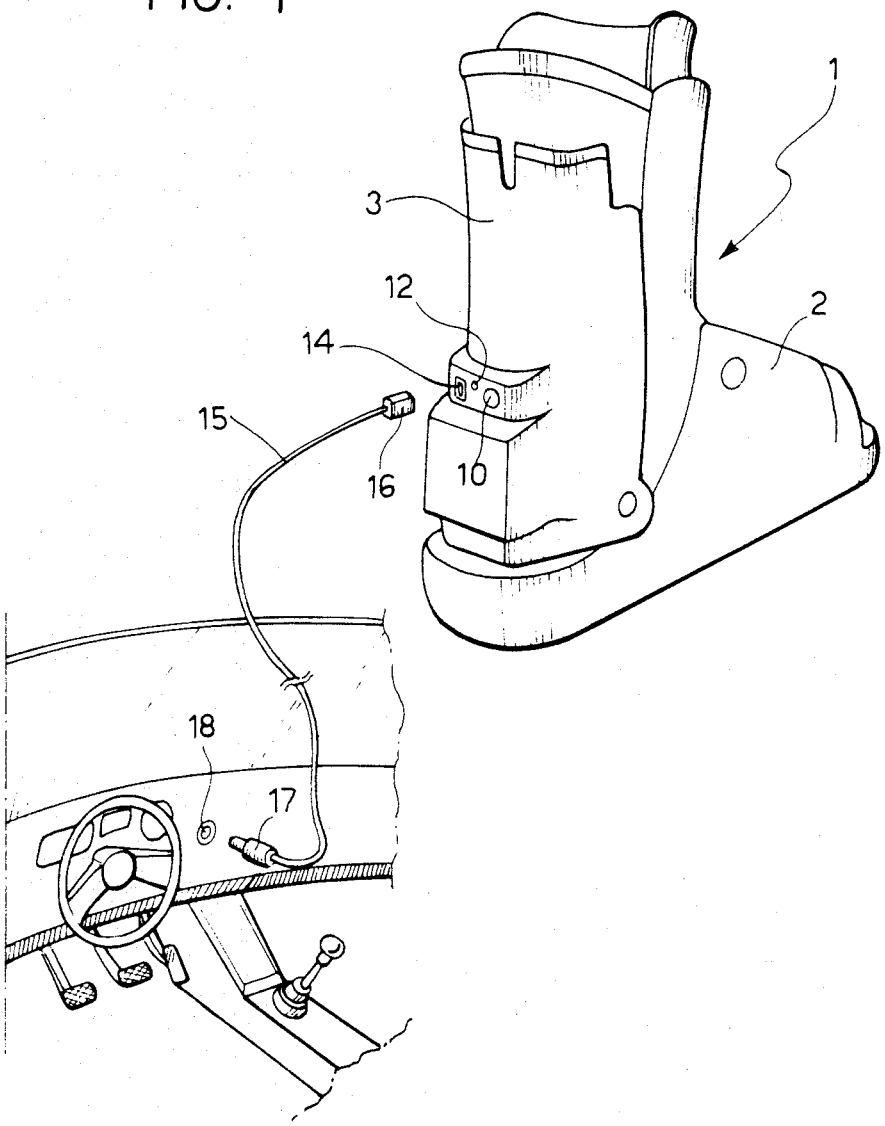
FIG. 1 is a perspective view of a ski-boot provided with a heater according to the invention.
Figure 2:
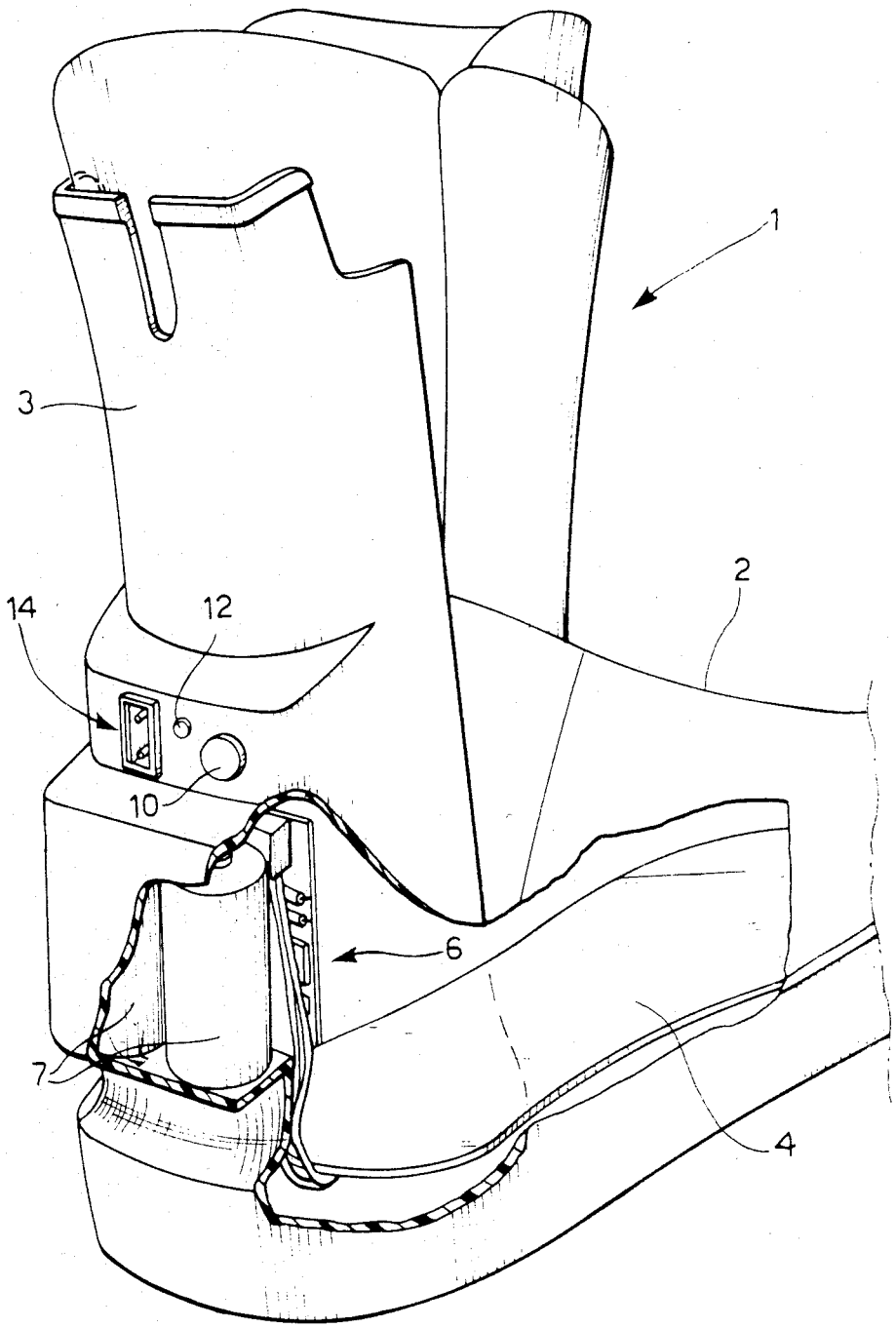
FIG. 2 is a partial-sectioned, partial perspective view of the ski-boot of FIG. 1.
Figure 3:
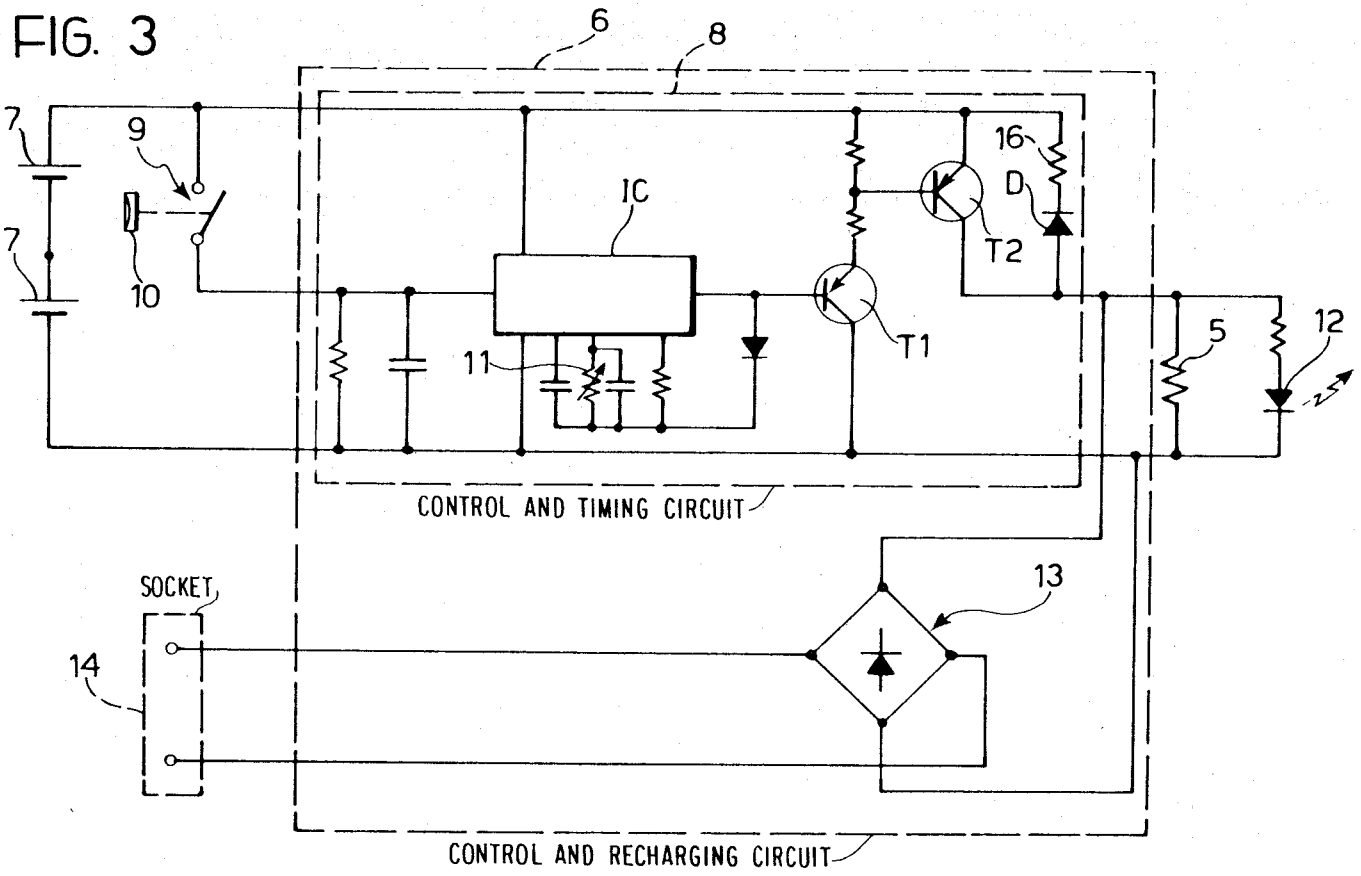
FIG. 3 is a partial-block schematic diagram of the circuit of the heater of the invention.

In FIG. 1, a ski-boot is generally indicated 1 and includes an upper 2 to which a rear leg 3 is articulated. In known manner, the upper 2 houses an inner shoe in which a removable insole, indicated 4 in FIG. 2, is inserted. A heating resistor, indicated 5 in FIG. 3, is incorporated in the front portion of the insole. This resistor is connected to a control and recharging circuit housed in a recess in the rear part of the leg 3 and generally indicated 6 in Figures 2 and 3. This circuit is connected to two rechargeable batteries 7, for example nickel-cadmium batteries, also housed in the rear recess in the leg 3.

The control and recharging circuit 6 includes a control and timing circuit 8 connected to the batteries 7 and to the heating resistor 5. A switch 9 is also connected in this circuit and is operable by means of a push-button 10 mounted in the rear part of the leg 2, as shown in particular in FIGS. 1 and 2. Each time the switch 9 is operated, the control and timing circuit 8 enables current to be supplied from the batteries 7 to the heating resistor 5 for a predetermined period of time. The control and timing circuit 8 may include, as shown in FIG. 3, an integrated timer IC and RC units to determine the time constants thereof and, in particular, the activation time for the heating resistor 5. Conveniently, as illustrated in FIG. 3, the control and timing circuit 8 includes a potentiometer 11 which enables the time constant of the duration of each heating phase to be altered. The output of the integrated timer IC controls the current supply to resistor 5 through two transistors indicated $T_1$ and $T_2$. A diode D and a resistor 16 are connected in parallel to transistor $T_2$.

In order to give the rechargeable battery 7 a longer working life, the control and timing circuit 8 is conveniently arranged to interrupt the supply of current to the heating resistor 5 automatically when the level of charge of the batteries 7 falls below a predetermined value. Hence, when the batteries 7 are charged, the duration of each heating phase started by operation of the push-button 10 is predetermined and constant, and equal to the value input by means of the potentiometer 11. If the level of charging of the batteries 7 falls below a minimum input threshold voltage of IC, the supply of the current to the heating resistor 5 is prevented.

A light-emitting diode 12 is connected in parallel with the resistor 5 and is mounted in the rear-part of the leg 3 adjacent the push-button 10. This diode is energised each time current is supplied to the heating resistor 5.

When the batteries 7 are insufficiently charged, notwithstanding the actuation of the push-button 10 current is not supplied to the heating resistor 5 and the diode 12 remains unlit to indicate to the user that it is necessary to recharge the batteries.

The control and recharging circuit 6 includes a recharging circuit 13 which, in the embodiment illustrated, is constituted by a Graetz-bridge rectifying circuit. This circuit has its input connected to a socket 14 and its output connected to the batteries 7 through the control and timing circuit 8. The output of the rectifying circuit 13 is also connected across the ends of the heating resistor 5, as shown in FIG. 3. By virtue of this connection, each time the socket 14 is connected to an external d.c. supply of suitable voltage, the rectifying circuit 13 supplies a recharging current to the batteries 7 through diode D and resistor 16 of the control circuit 8 and at the same time maintains a flow of current to the heating resistor 5. The heating resistor is thus activated automatically while the batteries 7 are being recharged. This possibility is particularly convenient in that it allows, for example, the ski-boots to be preheated in an optimum manner, conveniently eliminating any residual moisture, when the batteries 7 are being recharged before use.

Preferably, though not necessarily, the rectifying circuit 13 is of such a size as to allow the heating resistor 5 to be supplied with an electrical power greater than that which is supplied through the operation of the push-button 10, as a result of the connection of the socket 14 to a suitable voltage supply. Thus, the automatic preheating during recharging of the batteries is particularly intense and effective.

In order to recharge the batteries 7, it suffices to connect any d.c. current source of suitable voltage to the socket 14. With the use of a transformer with a suitable voltage reduction ratio, it is possible to connect the socket 14 to the a.c. mains.

Conveniently, the device according to the invention may be equipped with a supply cable 15 (FIG. 1) provided at one end with a connector 16 for coupling to the socket 14 and at the other end with a connector 17 for insertion in the cigar lighter socket 18 of a motor vehicle. This cable allows the batteries of the ski-boots to be recharged with the advantage of simultaneous preheating of the boots within the motor vehicle, for example, during the journey to a desired skiing resort. When this place has been reached, the ski-boots can be put on immediately, with the storage batteries fully recharged and the boots pleasantly and comfortably preheated.

Naturally, the invention extends to all embodiments which achieve equal utility by using the same innovative concept.

I claim:

1. A ski-boot heater comprising:

at least one heating resistor and at least one storage battery for mounting in a boot;

a socket for mounting in the boot in a position accessible from the exterior for connection to a source of D.C. voltage external of said boot for recharging said battery, and control circuit means connecting said socket, said battery and said resistor for controlling supply of current to the resistor, including a manually-operable switch for controlling the supply of current from the at least one battery to the resistor, wherein the control circuit means include a control and recharging circuit for enabling the supply of direct current to the resistor even when the at least one storage battery is connected through the socket to an external AC or DC electrical supply for recharging it, and wherein the control circuit means are arranged to enable the heating resistor to be supplied with an electrical power greater than that normally supplied to the resistor as a result of the operation of the switch each time the at least one battery is being recharged.

2. A heater according to claim 1 wherein the control and recharging circuit includes a control and timing circuit connected to the at least one battery, to the switch and to the heating resistor, and arranged to allow the supply of current from the at least one battery to the resistor for a predetermined period of time after each operation of the switch.

3. A heater according to claim 2, wherein the control and timing circuit includes manually-operable regulating means for enabling the setting of the duration of the period of time.

4. A heater according to claim 2, wherein the control and recharging circuit further includes a rectifying circuit whose input is connected to the socket, and wherein the heating resistor is connected to the output of the control and timing circuit and to the output of the rectifying circuit.

5. A heater according to claim 1, wherein it further includes a visual indicator for mounting on the boot and for activation each time the resistor is supplied.

6. A heater according to claim 1, wherein it further includes a supply cable having an adaptor which can be coupled to a socket of a motor vehicle, to enable supply of the resistor and recharging of the at least one battery with current supplied by a motor vehicle battery.

* * * * *